US006164306A

United States Patent [19]

Townsend

[11] Patent Number: 6,164,306

[45] Date of Patent: Dec. 26, 2000

[54] SANDPAD

[76] Inventor: George K Townsend, P.O. Box 4127, Kahaluu, Hi. 96744

[21] Appl. No.: 09/283,734

[22] Filed: Apr. 1, 1999

[51] Int. Cl.[7] ..... A45B 9/04; A45B 3/00

[52] U.S. Cl. ..... 135/77; 135/86; 135/66; 248/188.9

[58] Field of Search ..... 135/77, 78, 82, 135/86, 66; 268/188.9

[56] References Cited

U.S. PATENT DOCUMENTS 2,799,287 7/1957 Wagner .

4,098,283 7/1978 Tritle ..... 135/77

5,713,382 2/1998 Midcap ..... 135/84

*Primary Examiner*—Robert Canfield

[57] ABSTRACT

An improved walking aid to allow people who walk with canes, crutches and other walking devices to travel over sand, gravel and uneven areas. It consists of a pad made up of layers of flexible material with a non-flexible ring inside the pad. The ring sits around the outer edge for stability. It has a thin rubber layer on the bottom of the pad for traction on smooth surfaces such as pavement. It has a basket attached to the top of the pad which is adjustable for attaching and detaching quickly and easily to the existing walking device that one uses.

1 Claim, 4 Drawing Sheets

SANDPAD

BACKGROUND—FIELD OF INVENTION

My invention is an adaption to crutches, canes and other walking devices to enhance maneuverability in sand, gravel, uneven and/or softer surfaces.

My present invention more particularly relates to walking canes, crutches and other walking devices for use in the sand, gravel, uneven, and/or softer surfaces as well as non-slippery surfaces.

One problem with conventional walking canes is that when a person uses the cane in the sand they tend to sink several inches in the soft surface making maneuverability poor.

Another problem concerns operation of the cane or crutch on soft terrain, such as loose gravel, sand, or soft earth. An ordinary cane or crutch has a rubber cap on its lower end, adapted to resiliently deform and grip the walking surface. When the walking surface is soft, or loose, the lower end of the cane or crutch tends to sink several inches into the surface, so that the person has a tendency to topple sideways when he, or she, puts any weight on the cane or crutch, also making maneuverability poor. The rubber cap on the lower end of the cane, crutch, or walking device will not support the walking device on such soft terrain.

There have been several efforts to overcome the above noted problems. The Specialized Crutch Tip of U.S. Pat. No. 4,098,283 granted to Robert C. Tritle Jr. on Jul. 4, 1978 discloses a disk having a convex lower surface bound by a peripheral edge screwed into the conventional crutch tip. Requiring the existing crutch tip to be removed first prior to using his invention. The problem with this device is that it has a screw and washer attachment system which creates a pivotal point which when the cane or crutch is in use, will rock upon the screw area creating an unstable surface and possibly cause harm if it makes the person fall. And the fact that you have to completely remove the existing crutch tip and replace it with another tip specifically for sand in order to use this product. This is not only difficult for some people to do but it is very time consuming as well. After using the Specialized Crutch Tip in the sand, the user must take off the Specialized Crutch Tip and then replace it with the crutch tip that the user would normally use for daily usage to walk upon pavement, roadways and concrete.

The Walking Aid Safety Tip of U.S. Pat. No. 5,713,382 granted to Matthew E. Midcap on Feb. 3, 1998 discloses that it is made of a non-flexible rubber material to prevent wobbling and is made with a convex bottom. The problem is that it will dig into the sand or soft terrain with a rocking motion when the walking device is used in the sand or soft terrain. Another problem is that because it is made of a non-flexible rubber material, when attached to a cane, crutch or walking device, it will add more weight to walking device(s) making the lower ends of the walking devices much heavier which also means harder to move and use. This appears to be very cumbersome for the user.

SUMMARY OF THE INVENTION

The Sandpad is a device that works simultaneously with a crutch, cane, or walking device that is not used as a permanent fixture to the walking aid. It works independently creating its own unique surface allowing the user to walk on top of the Sandpad. Keeping the user above the sand and /or soft terrain without digging or sinking, into the soft surface. The Sandpad has a strap system attachment making it easy to attach and detach. The Sandpad is very lightweight.

OBJECTS AND ADVANTAGES

Accordingly, besides the objects and advantages of the strap system, light weight adaption product and ability to use this product on soft terrain without digging or sinking several inches into the soft terrain described above, several objects and advantages of the present invention are:

(a) to provide an adjustable strap system that can accommodate all of the different size crutch and cane tips.

(b) to provide a strap system whose production allows for a convenient, extremely rapid and economical use.

(c) to provide a closure which is both flexible and easy to use.

(d) to provide a closure that can be an assortment of colors to give the users a choice of color or preference.

(e) to provide a top surface of the pad itself in a variety of patterns making customizing possible.

(f) to provide a top surface of the pad that is nearly flat. That should any quantity of sand, gravel or other objects land on top of the pad while my invention is attached to the walking device, will easily fall off as the user continues to take each stride.

(g) to provide an inner surface of the pad that has a non-flexible ring built into the outer edge to make the pad sturdy.

(h) to provide an inner surface made of several layers of strong flexible material held together by adhesives, creating a strong but flexible body of the pad.

(i) to provide an inner surface made of several layers of strong flexible material allowing the consumer the option of their own preference on flexibility which can be factored by the specific need of the consumer.

(j) to provide a bottom surface made of a thin rubber so that weight is minimal.

(k) to provide a bottom surface made of a thin rubber to help the user to walk on pavement, roadways and such areas prior to and immediately after using my invention on sand, gravel, even, uneven and soft terrain. Providing the user with the maximum usage possible.

(l) to provide an overall product that can be used by persons of all ages from children to adults.

(m) to provide a product that can be attached and/or detached with the use of one hand. Making it easier for those persons with this type of need.

DRAWING FIGURES

In the drawings, closely related figures have the same number but different alphabetic suffixes.

REFERENCE NUMERALS IN DRAWINGS

| | | | |
|---|---|---|---|
| 10 | crutch | 14A | fabric |
| 12 | crutch tip | 14B | flexible material |
| 13 | basket | 14C | non-flexible ring |
| 13A | adjustable strap | 14D | rubber |
| 13B | nylon webbing strap | 15 | rivet, stitching, or adhesive |
| 13C | grip tab | 16 | outer edge stitching |
| 14 | pad | 17 | basket stitching |

SUMMARY

In accordance with the present invention the sandpad is a device which is attached to the lower end of a crutch, cane or walking device which has a wide base to give a greater surface for walking over soft and/or sandy terrain, an adjustable basket to fit a variety of sized crutch tips and a rubber layer for traction.

Description—FIGS. 1 to 6

A typical embodiment of the pad of the present invention is illustrated in FIGS. 1 to 6.

The sandpad is an adaptive device which aids maneuverability in sandy and soft surface areas. It is made up of FIG. 6 flexible material 14B such as canvas to give the pad 14 a solid yet pliable platform, a ring 14C is embedded between the layers of flexible materials 14B held together by adhesive(s), which makes the pad 14 sturdy and holds its shape. To enhance gripping on roadways, concrete and other types of surfaces FIG. 5 a thin layer of rubber 14D is attached to the bottom of the pad 14. For a decorative appearance, FIG. 4 a layer of fabric 14A is attached to the top of the pad 14. For attaching FIG. 1 the pad 14 to the crutch tip 12 a basket 13 is stitched 17 to the pad 14 which then wraps around the crutch tip 12 securing the sandpad to the crutch tip 12.

A grip tab 13C is used for easy handling. By using said grip tab 13C it helps to hold the sandpad in place while using the adjustable strap 13A to secure the sandpad to the crutch tip 12. The grip tab 13C can have the feature of securing itself to the nylon webbing strap 13B by simply overlapping the grip tab 13C over the top of the basket 13 rim and then downward. This makes the grip tab 13C blend in with the sandpad itself for a more pleasing look.

Figure 3:
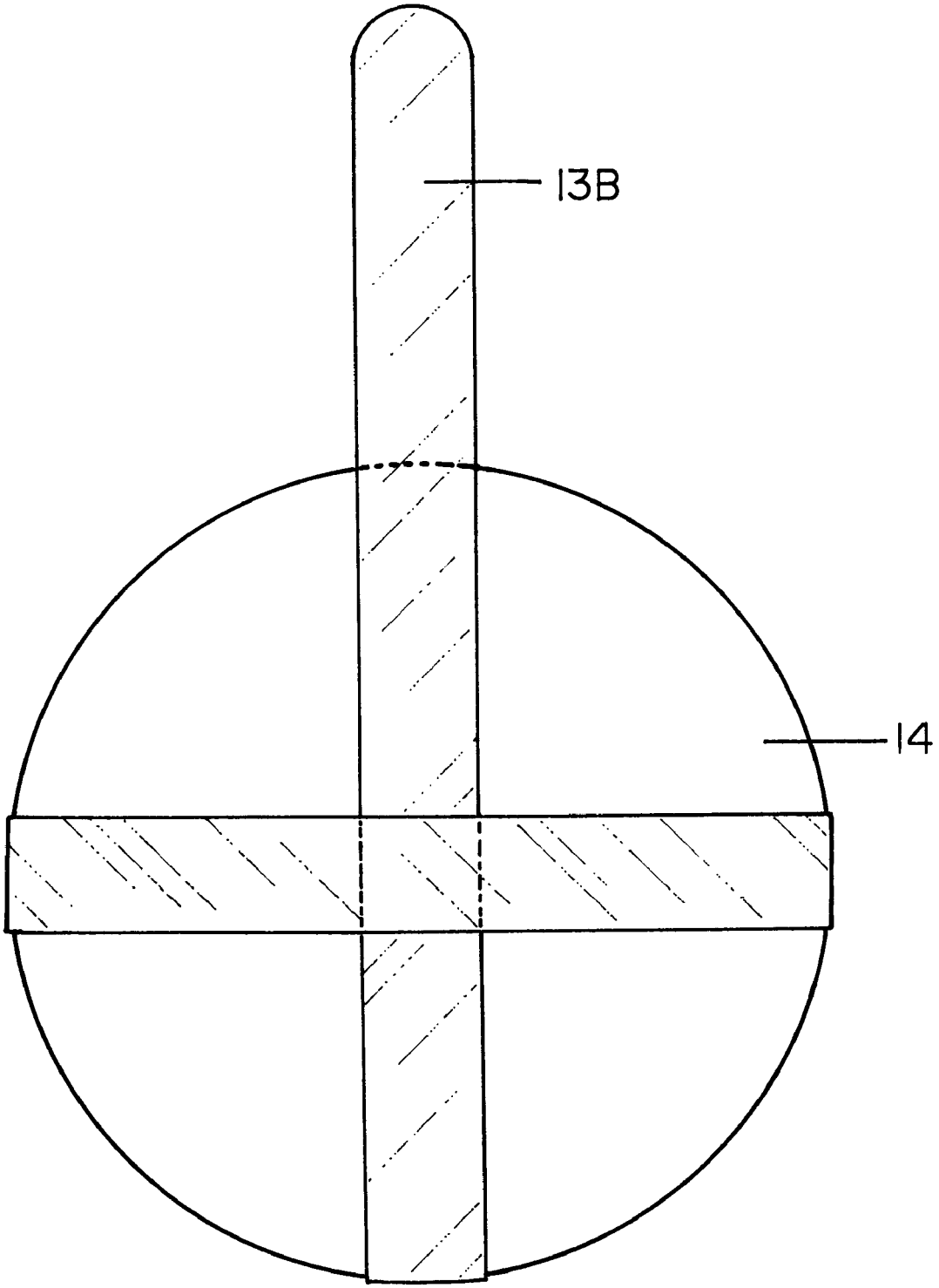
FIG. 3 shows a top view of the sandpad with the unassembled basket straps.
Figure 4:
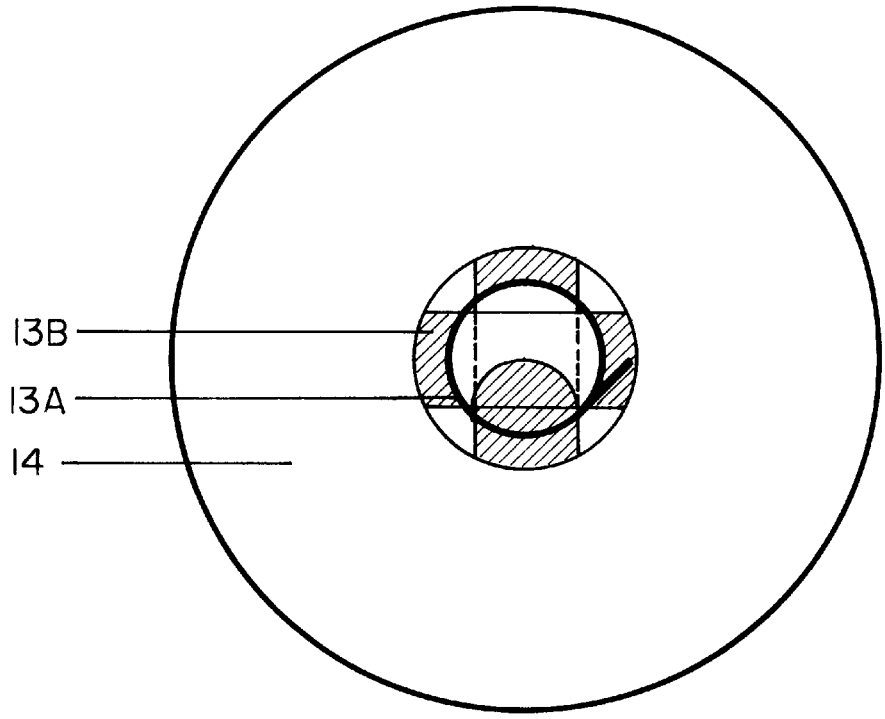
FIG. 4 shows a top view of the sandpad with basket assembled.
Figure 5:
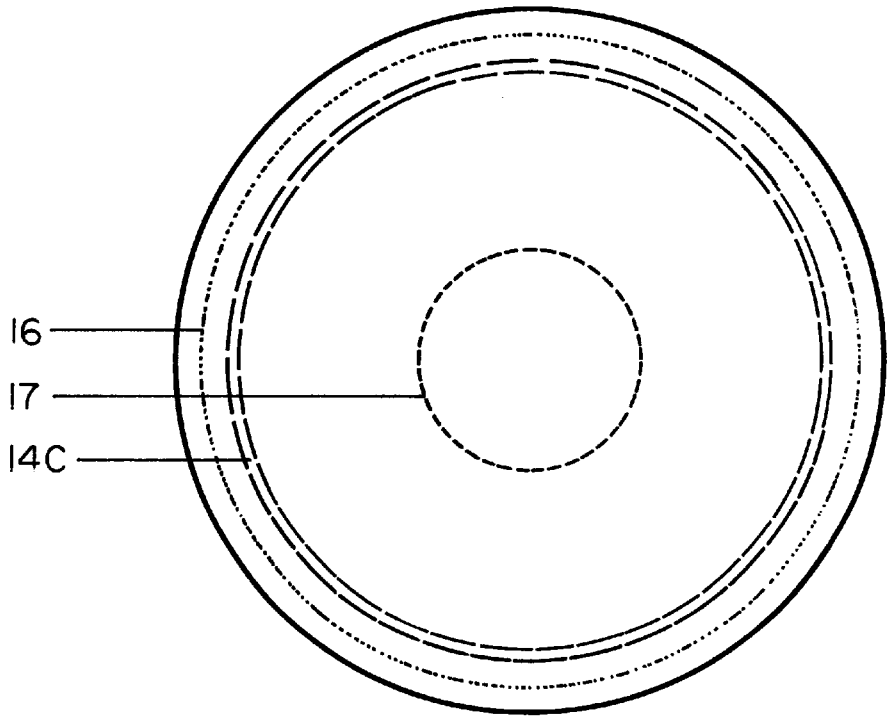
FIG. 5 shows a bottom view of the sandpad showing stitching and inside ring.

FIG. 3 basket 13 is made of a nylon webbing strap 13B which will conform to the shape of the crutch tip 12. By using nylon as opposed to cotton, creates a tighter grasp rather than cotton which would tend to slip making it not as secure.

Figure 6:
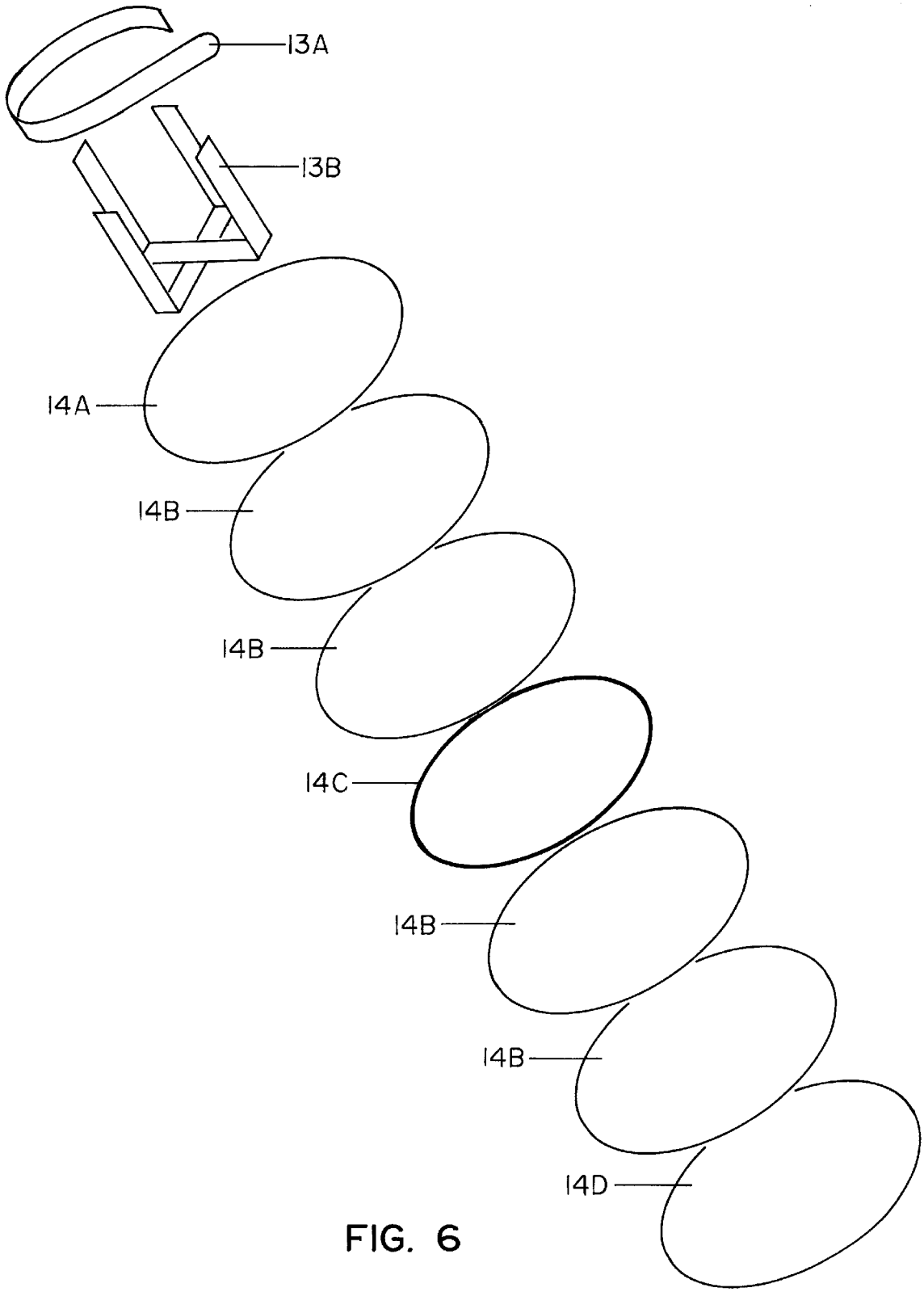
FIG. 6 is an exploded picture of the sandpad and basket.

Around the outer edge of the pad 14, stitching 16 is used to ensure the layers of FIG. 6 number 14A, 14B and 14D will not separate therefor keeping the integrity of the strength.

Figure 1:
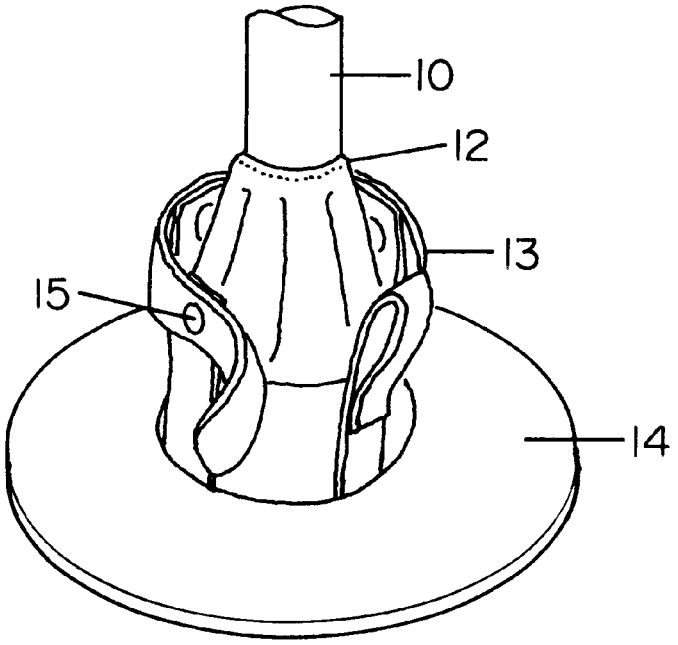
FIG. 1 shows a top view of a crutch tip with a rubber cap on its lower end being wrapped by a basket connected to the pad of the sandpad
Figure 2:
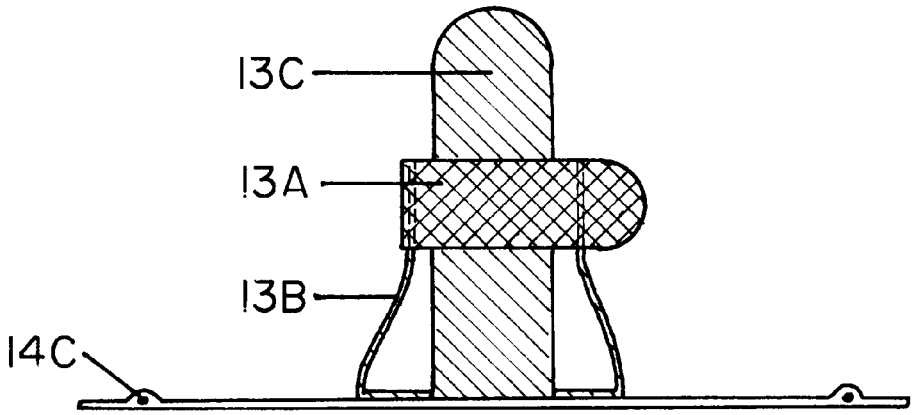
FIG. 2 shows a dissected view of the sandpad and basket

Being that the sandpad is not solidly affixed to the crutch FIG. 2, the user has a separate surface to actually walk on FIG. 3. The flexible material 14B, such as canvas, gives the user a natural feel to the walking device.

Flexible material 14B is used instead of a solid rubber compound so that it will not crack as would eventually happen with a solid rubber pad. Also, by using a flexible material 14B as opposed to solid rubber you now have a piece that would be of lighter weight than solid rubber.

Because of the adjustable strap 13A the sandpad is able to be attached to a wide variety of sized cane or crutch tips 12. The pad 14 may be made in a variety of sizes as well. Any person with a specific size or design preference is able to get a customized sandpad.

The sandpad is a device that is not restricted to crutches, canes and walking devices. It can also be used on many items used in sandy or soft terrain areas, such other items can include but not limited to; chair legs, tables legs, tent pole legs or any other item you wish to place on top of the sand or soft terrain rather than into the sand or soft terrain. It could also be used in indoor areas as a means to avoid scratch marks on flooring by attaching the items legs or footings into a sandpad, now making the item touching the sandpad alone rather than the flooring.

Operation—FIGS. 1 to 6

The manner of attaching the sandpad to the lower end of a cane of crutch tip 12 is to first lift up the grip tab 13C from the side of the sandpad. If desired, hold the grip tab 13C with one hand and grab the end of the adjustable strap 13A, pulling the adjustable strap 13A clockwise. Now you will have an opening to slide the crutch tip 12 (FIG. 1) into the center of the basket 13. Next, pull the adjustable strap 13A counter clock wise being sure that you pull to a snug fit around the crutch tip 12, laying the end of the adjustable strap 13A on top of the rim of the basket 13. Finally, bend the grip tab 13C over the top of the basket 13, pulling in a downward motion. Then affix the tip of the grip tab 13C to the nylon webbing strap 13B.

The manner of using the sandpad itself, first attach the sandpad to the crutch tip 12 that the user normally uses, the crutch moves in a normal manner as if it were being used on harder surfaces than sand. Because the sandpad is larger than the lower end of a walking device, it helps to create a larger surface than a crutch tip 12, helping to disburse the weight of the user and the walking device.

The sandpad can be attached to the original cane or crutch tip 12 that one uses on a regular basis or use it on a different cane or crutch; one simply opens the grip tab 13C, pull the adjustable strap 13A again prior to reuse.

The sandpad can be customized for more water resistence by simply interchanging the types of flexible material 14B used. It is important however, that the material have some flexibility and still have a non-flexible ring 13C so that the shape and integrity stays in place.

Conclusion, Ramifications, and Scope of Invention

Thus, the reader will see that the sandpad invention provides a highly reliable, lightweight, yet economical device that can be used by persons of almost any age.

While my above description contains many specificities, these should not be construed as limitations on the scope of the invention, but rather as an exemplification of one preferred embodiment thereof. Many other variations are possible. For example, size: one size fits all cane tips, another size fits all crutch tips, customizing with color preference, customizing for individual flexibility preference, etc.

Accordingly, the scope of the invention should be determined not by the embodiment(s) illustrated, but by the appended claims and their legal equivalents.

What is claimed is:

1. An attachment for walking aids for primary use in soft terrain, comprising: a pad comprised of:

several layers of flexible material adhered together with adhesives, a non-flexible ring inside the layers of flexible material, a top side of fabric having a decorative appearance, the layers of flexible material and top side fabric being stitched together, a basket attachment system comprised of:

an adjustable strap system adapted to accommodate different size crutch and cane tips, said adjustable strap system having side straps stitched to the top of the pad, and an adjustable strap that can be tightened to actual crutch and cane tip sizes attached to the top of the side straps, said adjustable strap attachable to itself and having a grip tab for easy attaching and detaching, and a bottom side comprised of:

a thin rubber bottom layer which is stitched and adhered to a bottom side of the pad, the thin rubber bottom layer adapted to grip surfaces such as pavement.

* * * * *